US006229977B1

(12) United States Patent
Wang et al.

(10) Patent No.: US 6,229,977 B1
(45) Date of Patent: May 8, 2001

(54) DEVELOPER CONTAINER

(75) Inventors: Jui-Chi Wang; Robin Hsu; Ya-Li Huang; Kuan-Tung Li, all of Taichung County (TW)

(73) Assignee: General Plastic Industrial Co., Ltd., Taichung County (TW)

( * ) Notice: Subject to any disclaimer, the term of this patent is extended or adjusted under 35 U.S.C. 154(b) by 0 days.

(21) Appl. No.: 09/577,432

(22) Filed: May 22, 2000

(51) Int. Cl.[7] ..... G03G 15/08
(52) U.S. Cl. ..... 399/262; 399/263; 222/DIG. 1
(58) Field of Search ..... 220/675; 222/DIG. 1, 222/325; 399/119, 120, 262, 263

(56) References Cited

U.S. PATENT DOCUMENTS 5,918,090 * 6/1999 Ichikawa et al. ..... 399/120

FOREIGN PATENT DOCUMENTS 10-171231 * 6/1998 (JP) .

* cited by examiner

*Primary Examiner*—Arthur T. Grimley
*Assistant Examiner*—Hoang Ngo
(74) *Attorney, Agent, or Firm*—Pro-Techtor International Services

(57) ABSTRACT

A container body installed in an image forming apparatus to supply developer, having a spiral developer guide spirally extended around an inside wall thereof for guiding developer out of a front opening thereof, the spiral developer guide having a spiral guide way formed of flat surface portions and sloping surface portions alternatively connected in series, and two spiral flanges spirally formed integral with the inside wall of the container body along the series of flat surface portions and sloping surface portions at two opposite lateral sides.

2 Claims, 2 Drawing Sheets

DEVELOPER CONTAINER

BACKGROUND OF THE INVENTION

The present invention relates to a developer container for use with an image forming apparatus, and more particularly to a developer passage control arrangement for a developer container.

A regular developer container for use with an image forming apparatus is generally comprised of a container body having a front opening through which developer is supplied in or out, and a spiral guide way smoothly extended from the close bottom end toward the front opening. This structure of developer container is still not satisfactory in function. When rotating the developer container to propel developer out of the developer container to the image forming apparatus, a laminar flow of developer or bridging phenomenon may occur, causing developer to be condensed into blocks.

SUMMARY OF THE INVENTION

The present invention has been accomplished to provide a developer container, which eliminates the occurrence of a laminar flow or bridging phenomenon when supplying developer to the image forming apparatus in which the developer container is installed. According to the present invention, the container body of the developer container has a spiral developer guide means that smoothly guides developer out of the front opening of the container body to the image forming apparatus during rotary motion of the developer container. The spiral developer guide means comprises a spiral guide way formed of flat guide surface portions and sloping guide surface portions alternatively connected in series.

DETAILED DESCRIPTION OF THE PREFERRED EMBODIMENT

Figure 1:
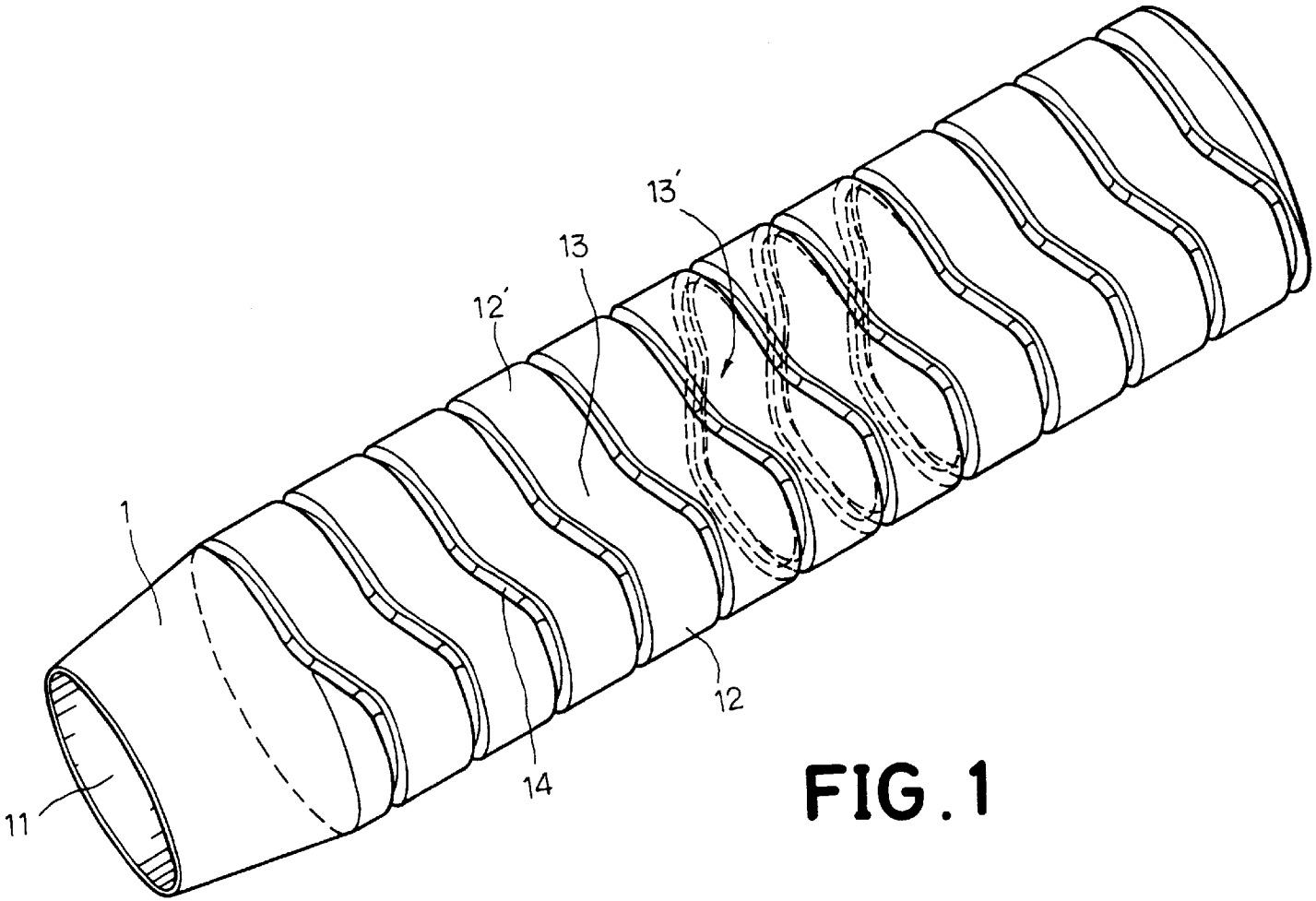
FIG. 1 is a perspective view of a developer container according to the present invention.
Figure 2:
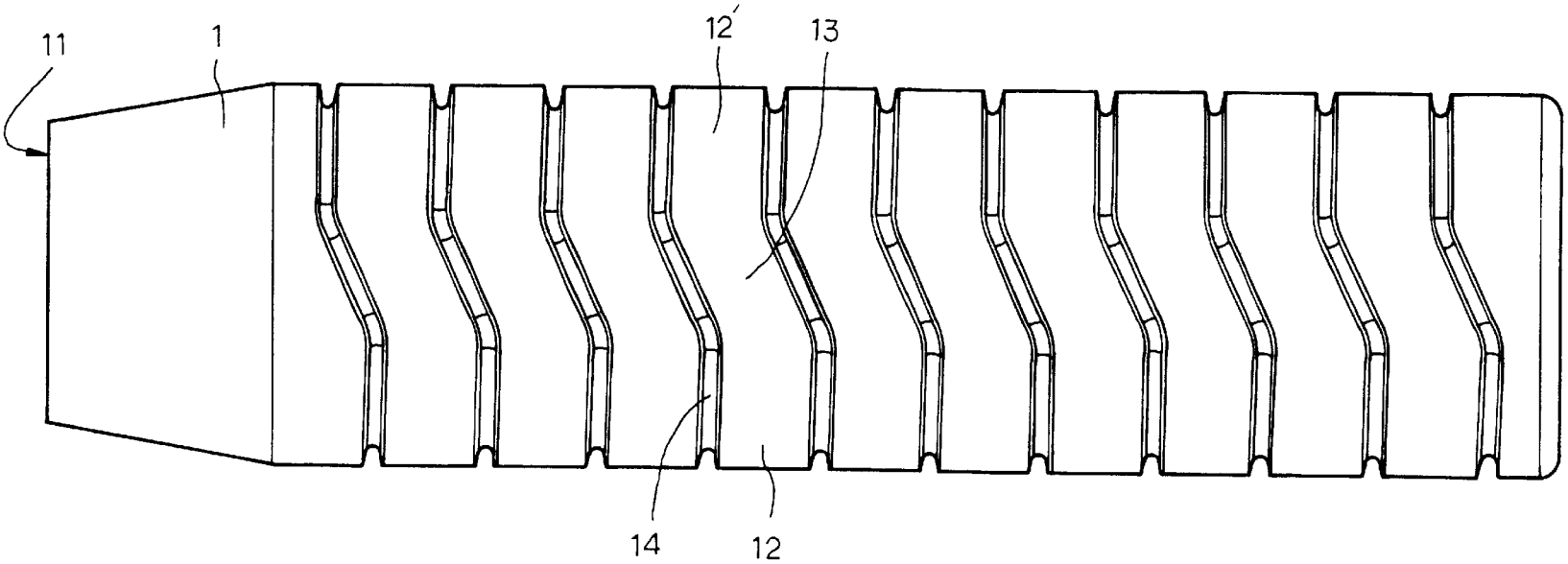
FIG. 2 is a side elevational view of the developer container shown in FIG. 1.

Referring to FIGS. 1 and 2, a developer container is shown comprising a container body 1. The container body 1 has one end, namely, the rear end closed, and an opening 11 at the other end, namely, the front end through which developer is propelled out of the container body 1 and supplied to the image forming apparatus in which the container body 1 is installed. A spiral developer guide means is provided inside the peripheral wall of the container body 1 and spirally extended from the close bottom end of the container body 1 toward the opening 11. The spiral developer guide means is comprised of a spiral guide way formed of flat surface portions 12 and 12' and sloping surface portions 13 and 13' alternatively connected in series, and two spiral flanges 14 spirally formed integral with the inside wall of the container body 1 along the series of flat surface portions 12 and 12' and sloping surface portions 13 and 13' two opposite lateral sides.

Further, a toothed connector (not shown) is provided at the front side of the container body 1 for enabling the container body to be connected to any of a variety of image forming apparatus.

During the operation of the image forming apparatus in which the developer is installed, the container body 1 is rotated with a driving mechanism of the image forming apparatus, causing developer to be smoothly propelled forwards toward the opening 11 along the spiral guide way defined between the spiral flanges 14. The spiral developer guide means prevents the occurrence of a laminar flow or bridging phenomenon.

What the invention claimed is:

1. A container body for a developer container used in an image forming apparatus to supply developer, said container body comprising:

a generally spiral developer guide means extended around an inside wall thereof from a closed rear end toward a front opening thereof for guiding developer out of said front opening, said spiral developer guide means comprising a spiral guide way formed of straight linear portions and curved connecting portions alternatively connected in series.

2. The container body of claim 1 wherein:

said inside wall further comprises two flanges formed integral to said inside wall along two opposite lateral sides.

* * * * *